United States Patent [19]

Price, Jr.

[11] Patent Number: 4,784,530

[45] Date of Patent: Nov. 15, 1988

[54] ROOF BOLT APPARATUS

[76] Inventor: Stanley J. Price, Jr., 4344 Brownsville Rd., Pittsburgh, Pa. 15227

[21] Appl. No.: 107,258

[22] Filed: Oct. 9, 1987

Related U.S. Application Data

[63] Continuation of Ser. No. 907,900, Sep. 16, 1986, which is a continuation-in-part of Ser. No. 687,731, Dec. 31, 1984, abandoned.

[51] Int. Cl.[4] ..... E21D 20/02; E21D 21/00

[52] U.S. Cl. ..... 405/259; 405/261; 411/60; 411/385; 411/15

[58] Field of Search ..... 405/259, 260, 261; 411/437, 324, 385, 383, 55, 57, 54, 60, 15, 901, 904, 26, 44, 45, 47, 49–53, 65, 67, 378, 395

[56] References Cited

U.S. PATENT DOCUMENTS

| | | | |
|---|---|---|---|
| 3,416,230 | 12/1968 | Oleson et al. | 411/54 X |
| 3,528,253 | 9/1970 | Kovacs . | |
| 3,938,420 | 2/1976 | Draa . | |
| 4,295,761 | 10/1981 | Hansen . | |
| 4,419,805 | 12/1983 | Calandra . | |
| 4,483,645 | 11/1984 | White et al. . | |

FOREIGN PATENT DOCUMENTS

| | | | |
|---|---|---|---|
| 1126823 | 4/1962 | Fed. Rep. of Germany | 405/260 |
| 1515194 | 1/1968 | France | 411/385 |
| 526709 | 10/1976 | U.S.S.R. | 405/259 |
| 2022756 | 12/1979 | United Kingdom | 405/259 |

*Primary Examiner*—Dennis L. Taylor

*Attorney, Agent, or Firm*—Stanley J. Price, Jr.

[57] ABSTRACT

The apparatus for anchoring a bolt includes an elongated bolt with a threaded portion located at a preselected position along the length of the bolt and spaced from the end portions of the bolt. An expansion shell assembly is positioned on the bolt with the camming plug portion threadedly secured to the bolt threaded portion so that the expansion shell assembly is positioned in spaced relation to the ends of the bolt. In one embodiment, the threaded portion of the bolt includes a threaded sleeve suitably secured to the bolt at a location between the end portions of the bolt. In another embodiment, the bolt has a threaded portion located between the unthreaded end portions and a C-shaped stop member is secured on the lower portion of the threads. A camming plug is formed in longitudinal halves that are positioned around the threaded portion of the bolt and held in place by the fingers of the expansion shell assembly. A method is also disclosed where the threaded portion of the bolt is located at a preselected location between the ends of the bolt and the expansion assembly is threadedly engaged to the threaded portion of the bolt at the preselected location and is expanded to engage the bore hole at that location. A chemical bond may also be employed to engage another portion of the bolt to the bore hole.

15 Claims, 4 Drawing Sheets

ROOF BOLT APPARATUS

CROSS REFERENCE TO COPENDING APPLICATION

This application is a continuation of Ser. No. 907,900 filed Sept. 16, 1986 which is a continuation-in-part of Ser. No. 687,731 filed Dec. 31, 1984, now abandoned. Both applications were entitled "Roof Bolt Apparatus" and the inventor was Stanley J. Price, Jr.

BACKGROUND OF THE INVENTION

1. Field of the Invention

This invention relates to a method and apparatus for anchoring a roof bolt in a bore hole of a rock formation and more particularly to an expansion shell assembly that is capable of being positioned at a preselected location along the length of a roof bolt to control the point of mechanically anchoring the roof bolt in the bore hole.

2. Description of the Prior Art

It is well known to reinforce and stabilize underground rock formations, such as a coal mine roof, a subway tunnel, or a similar subterranean structure or to strengthen a rock mass by the use of anchor bolts inserted within a bore hole drilled in the rock formation. The anchor bolts are tensioned during installation to reinforce the unsupported rock formation above the roof, for example, above the roof of a mine passageway. Conventionally, a hole is drilled through the roof of the rock formation, and a rock bolt is inserted and anchored in the drilled hole either by engagement of a mechanical expansion shell with the wall of the rock formation around the hole or chemically anchoring the bolt by a multi component resin system or grout to the rock formation surrounding the hole.

With a mechanical expansion shell, the end of the bolt is threaded to receive the camming plug with an expansion shell positioned around the camming plug on the end of the bolt. Rotation of the bolt advances the camming plug downwardly relative to the shell to expand the fingers of the shell into gripping engagement with the rock formation. Thus, the expanded shell is anchored in the bore hole at the end of the bolt, and consequently the location of the expansion of the shell is fixed in the bore hole at the end of the bolt.

In a grout or resin anchoring system, the cartridges containing the separated chemical components are advanced into the bore hole ahead of a reinforcing rod. The cartridges are ruptured as the end of the rod passes through the cartridges and is rotated. Rotation of the rod effects the mixing of the components. The mixture penetrates into the surrounding rock formation to adhesively unite the rock strata and anchor by bonding the rod to the rock formation surrounding the bore hole. The mixed resin or grout fills the annulus between the bore hole wall and the rod along a substantial length of the rod.

U.S. Pat. Nos. 3,108,443; 3,892,101; 3,940,941; 3,979,918; 4,051,683; 4,127,000; 4,129,007; 4,263,832; and 4,303,354 are examples of systems that use a grout or resin to anchor a roof bolt in a rock formation. U.S. Pat. Nos. 3,925,996 and 4,216,180 disclose multi component resin systems in which the resin mixture cures and begins to harden within a few seconds after mixing.

U.S. Pat. Nos. 3,877,235; 4,051,683; 4,023,373; and 4,275,975 disclose chemically anchored roof bolt systems that include an anchor portion which is inserted into the bore hole behind one or more resin cartridges and a lower portion which is connected to the anchor portion. With these devices, once the resin components are mixed and the mixture is cured to adhesively secure the anchor portion in the bore hole, application of a predetermined amount of torque to the bolt below the anchor portion releases the bolt for rotation relative to the anchor portion to draw a roof plate on the end of the bolt into compressive relation with the rock formation. In this manner the bolt is put under tension.

U.S. Pat. Nos. 4,129,007 and 4,132,080 disclose an anchor member that is internally threaded to receive the threaded end of the bolt. Both the anchor member and the bolt rotate initially as a unit to effect mixing of the resin. The bolt is not rotated during the time in which the mixed resin is permitted to set. After setting of the mixed resin, the bolt is rotated and the anchor member is restrained against rotation of the bore hole by setting of the resin. A preselected torque is applied to the bolt to tension the bolt.

U.S. Pat. Nos. 4,413,930 and 4,419,805 disclose method and apparatus for combining resin bonding and mechanical anchoring of bolt in a rock formation. With these devices a single bolt with a mechanical anchor positioned on the upper threaded end of the bolt is inserted in the bore hole behind the cartridge system. A roof plate is carried on the opposite headed end of the bolt for abutment against the rock formation surrounding the open end of the bore hole. The cartridge system is ruptured by the simultaneous upward thrust and rotation of the bolt to release the resin components for mixing. A stop device or other means associated with the expansion shell restrains expansion of the shell when the bolt is rotated in a preselected direction to mix the resin components. Rotation of the bolt continues without expansion of the shell for a predetermined period of time to permit the resin mixture to cure. As the resin mixture begins to harden, the shell expands into engagement with the wall of the bore hole and further rotation of the bolt exerts a tension on the bolt.

For both the mechanical anchor system and the combination resin and mechanical anchor system, it is the conventional practice to place the expansion shell assembly on the upper threaded end of the bolt. Normally the bolt is only threaded about four inches at the upper end portion to receive the expansion shell and, in some applications, at the lower end portion to receive a tightening nut. Consequently, the location in the bore hole where the shell member is expanded is limited to the area adjacent the end of the bore hole.

It is well known that the rock strata of a rock formation above an underground passageway can include a bedded formation of a variety of rock strata, such as shale, sandstone, mudstone, coal, and other rock laminations. The strata of a bedded formation vary in seam thickness and the seams may extend in a random path that deviates from a horizontal bedded formation. While certain strata such as slate may be very stable, the stable strata may be relatively thin, so that anchorage of the bolt end portion in the thin stable strata does not provide adequate support for the entire roof. With this type of roof it has been necessary in the past to drill bore holes through the strata above the stable slate to the next seam of stable slate or rock and anchor the end of the bolt by an expansion shell in the stable rock formation. In many instances this requires inordinately long bolt holes or bolt sections coupled to each other. The strata forming the roof immediately above the stable slate seam may be soft, and friable, and not provide adequate anchorage for an expansion shell. Thus, a mechanical anchor, which is tensioned during installation in a bed of soft, friable material is subject to slippage and loss in bolt tension as a result of deterioration of the surrounding material.

The use of a resin grouted bolt in the soft friable strata, provides a more suitable anchorage for the bolt end portion. The resin does not provide a tension on the bolt and as previously discussed, modifications must be made to the bolt system, such as a threaded external end on the bolt and a separate nut, to apply a tension to the bolt.

In an effort to maintain a larger area of contact between the expanded shell member with soft rock strata, special multiple anchors positioned in tandem on a bolt have been developed, as disclosed in U.S. Pat. No. 3,469,407. With this arrangement, two or more expansion shell assemblies are positioned on the threaded end portion of the bolt. The expansion shells are simultaneously expanded on the bolt end portion and anchored in the bolt hole. Accordingly, by increasing the threaded length of the bolt, the tandem arrangement of expansion shell assemblies can be spaced apart where, for example, the upper assembly is positioned in hard strata and the lower assembly is positioned in soft strata. Longitudinal spacing of the expansion shell assemblies on the threaded length of the bolt is controlled by a plastic tube, which is positioned between the assemblies.

U.S. Pat. No. 2,525,198 discloses an anchor bolt that includes an upper expansion shell assembly mounted on an upper threaded bolt, which is connected by a tubular member of a preselected length, to a lower threaded bolt, which is threaded into the opposite end of the tubular member. A lower expansion shell assembly is positioned on the lower threaded bolt. With this arrangement, the area of contact of the mechanical anchor with the rock formation is expanded. U.S. Pat. No. 3,303,736 discloses an expansion shell assembly adapted for positioning anywhere on the threaded portion of the bolt.

While it has been suggested by the prior art devices to utilize a combination of mechanical and chemical anchors to secure a bolt in a bore hole to overcome the problems associated with loss in bolt tension of a mechanically anchored bolt due to deterioration of the surrounding rock formation, the prior art devices limit the location of the expansion shell assembly to a specific threaded portion of the bolt which is generally at the upper end of the bolt. The development of multiple anchors in tandem arrangement on a roof bolt also requires that a substantial length of the bolt be threaded or threaded extension members be utilized with an unthreaded bolt.

It also has been suggested by the prior art devices to locate an expansion shell assembly at a desired location along the threaded length of a bolt. This requires that the bolt be threaded a considerable length, if not along its entire length. Threading a rock bolt along its entire length substantially increases the costs of a rock bolt and requires special handling to insure that the threads do not become damaged. Therefore, there is a need for roof bolt apparatus that includes an expansion shell assembly which is secured to a reinforcing rod or bolt at a preselected location along the length of the bolt, so as to permit adjustments in the location where the expanded shell member contacts the rock formation without requiring that the bolt be threaded at specific points along the length of the bolt or threaded along its entire length.

SUMMARY OF THE INVENTION

In accordance with the present invention, there is provided an expansion shell assembly that includes a sleeve having a body portion with an upper end portion and a lower end portion and an axial bore extending through the body portion. The sleeve body portion has an inner surface and an outer threaded surface. A camming plug having a threaded axial bore and an outer surface is threadedly engaged to the sleeve at a selected location on the sleeve outer threaded surface. An expandable shell has a plurality of longitudinally extending fingers spaced one from another by longitudinal slots. The fingers each have an inner surface and an outer surface. Each finger inner surface abuts the camming plug outer surface. The camming plug is movable on the sleeve outer surface relative to the expandable shell to exert an outward force upon the inner surfaces of the fingers to expand the fingers outwardly from the sleeve. The expansion shell assembly is arranged to be positioned on a bolt at a preselected location along the length of the bolt with the inner surface of the sleeve secured to the outer surface of the bolt.

Further in accordance with the present invention, there is provided apparatus for anchoring a bolt in a bore hole of a rock formation that includes an elongated bolt with a threaded portion located at a preselected position along the length of the bolt spaced from the end portions of the bolt and unthreaded portions between the threaded portion and the bolt end portions. A camming plug has a unitary body portion with a threaded axial bore therethrough and an outer surface. The camming plug is threadedly engaged to the bolt threaded portion at the preselected location along the length of the bolt. An expandable shell has a plurality of longitudinally extending fingers. The fingers each have an inner surface and an outer surface. Each finger inner surface abuts the camming plug outer surface. The camming plug is movable on the bolt threaded portion relative to the expandable shell to exert an outward force on the inner surface of the fingers to expand the fingers outwardly from the bolt threaded portion and anchor said bolt in a bore hole at a location spaced from said bolt end portions.

Further, in another embodiment of this invention, there is provided apparatus for anchoring a bolt in a bore hole in which the bolt has a threaded portion positioned at a preselected location between the end portions. A stop member is threadedly engaged to the threaded portion of the bolt. A conventional expansion shell is positioned in coaxial relation around said bolt with its lower ring-like portion in abutting relation with the stop member. A camming plug having two separate portions is positioned around the threaded portion of the bolt member in abutting relation with the bolt threads and the separate portions of the camming plug are urged toward each other by the fingers of the expansion shell. With this arrangement, the bolt has a threaded portion at a selected location along the length of the bolt and the stop member expansion shell and camming plug are operably positioned on the threaded portion of the bolt so that upon rotation of the bolt, the camming plug moves downwardly on the threaded portion of the bolt to expand the fingers of the expansion shell into anchoring relation with the bore hole wall.

Further in accordance with the present invention, there is provided a method of anchoring a bolt in a bore hole of a rock formation that includes positioning an expandable shell around a sleeve. The expandable shell has a ring portion with fingers extending therefrom and the sleeve has an outer threaded surface. A camming plug with the expansion shell mounted thereon is threadedly engaged to the sleeve to form an expansion shell assembly. The expansion shell assembly is axially secured to the outer surface of a roof bolt at a preselected location along the length of the roof bolt. The bolt with the expansion shell assembly mounted thereon is inserted into a bore hole of a rock formation and is rotated to move the camming plug axially on the threaded sleeve relative to the expandable shell to expand the fingers and anchor the roof bolt in the bore hole by the expansion shell assembly at a preselected location along the length of the roof bolt.

There is also provided a method of anchoring a bolt in a bore hole of a rock formation that includes providing a bolt with a threaded portion spaced from the end portions of the bolt and unthreaded portions between the threaded portion and the bolt end portions, an expandable shell is positioned around the bolt. The expandable shell has finger portions. A camming plug is threadedly engaged to the threaded portion of the bolt and the expandable shell fingers are engaged to the camming plug. The bolt with the camming plug and expansion shell mounted thereon is inserted into the bore hole of the rock formation and the bolt is rotated to move the camming plug axially on the threaded portion of the bolt relative to the expandable shell to expand the fingers on the expandable shell and anchor the bolt in the bore hole at a location spaced from the end portions of the bolt.

The method of assembling the expansion shell assembly on the roof bolt includes first securing the stop nut on the threaded sleeve member and thereafter positioning the expansion shell on the threaded sleeve and threadedly securing the camming plug on the sleeve with the camming plug positioned between the expansion shell fingers and on the threaded sleeve portion. The threaded sleeve portion is then adhesively secured to the bolt at any preselected location with the expansion shell assembly positioned thereon.

There is also provided a method for anchoring a bolt in a bore hole that includes the steps of securing one or more of the above described expansion shell assemblies at predetermined locations along a bolt. Resin cartridges are first positioned in the bore hole and the bolt with the expansion shell assemblies secured thereto is advanced into the bore hole. The end of the bolt fractures the resin cartridges and the bolt is rotated to mix the resin material. Rotation of the bolt also moves the camming plugs of the expansion shell assemblies axially on the threaded sleeves and expands the fingers of the expansion shells. The bolt is thus anchored both mechanically by the expansion shells and chemically by the resin in the bore hole.

Accordingly, the principal object of the present invention is to provide both a method and apparatus for anchoring a bolt in a bore hole of a rock formation by selectively locating in the bore hole the point where an expansion shell contacts the rock formation in the bore hole.

Another object of the present invention is to provide a method and apparatus for mechanically anchoring a roof bolt in a rock formation by securing an expandable shell assembly to a roof bolt at a preselected location along the length of the bolt in order to expand the shell into contact with the rock formation at a selected location in the bore hole.

An additional object of the present invention is to provide a roof bolt assembly which is capable of both mechanical and chemical anchoring in a bore hole of a rock formation where the point of mechanical anchoring is selected along the length of the bolt in the bore hole and the end of the bolt is chemically anchored in the bore hole.

These and other objects of the present invention will be more completely disclosed and described in the following specification, the accompanying drawings and the appended claims.

DESCRIPTION OF THE PREFERRED EMBODIMENTS

Figure 1:
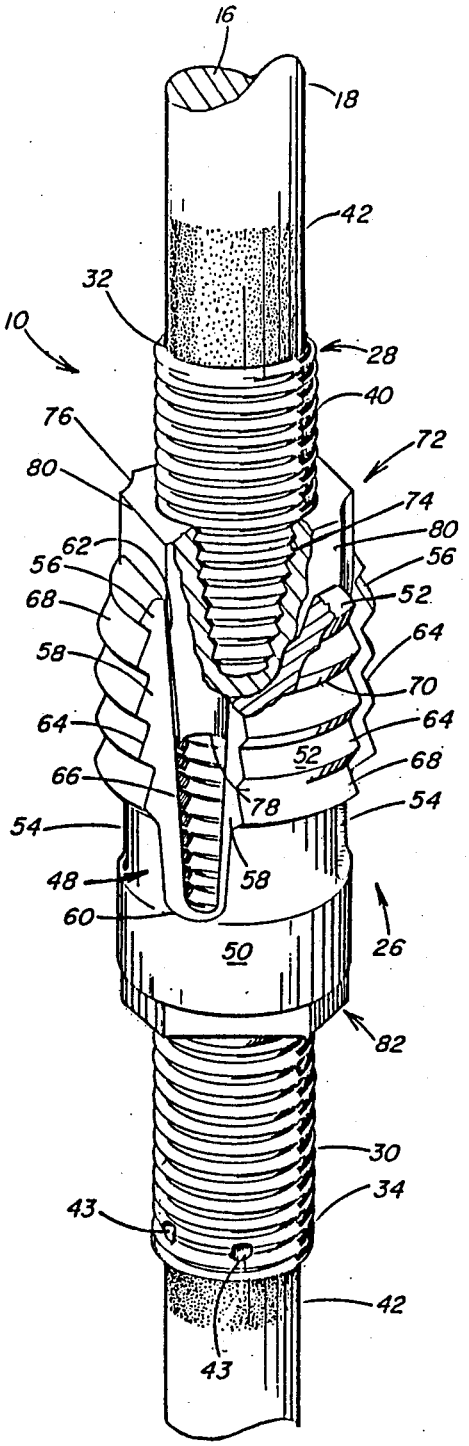
FIG. 1 is an enlarged, fragmentary, isometric view, partially in section, of roof bolt apparatus having an expansion shell assembly including an externally threaded sleeve secured to the bolt with an expansion shell and camming plug engaging the sleeve.

Referring to the drawings and particularly to FIGS. 1, 2 and 6–9, there is illustrated roof bolt apparatus generally designated by the numeral 10 for insertion in a bore hole 12 of a rock formation, shown in detail in FIGS. 6–9, to support the rock formation 14. The rock formation 14 ca example, a mine roof that overlies a mine passageway or shaft, a subway tunnel, or other similar subterranean structure.

Figure 2:
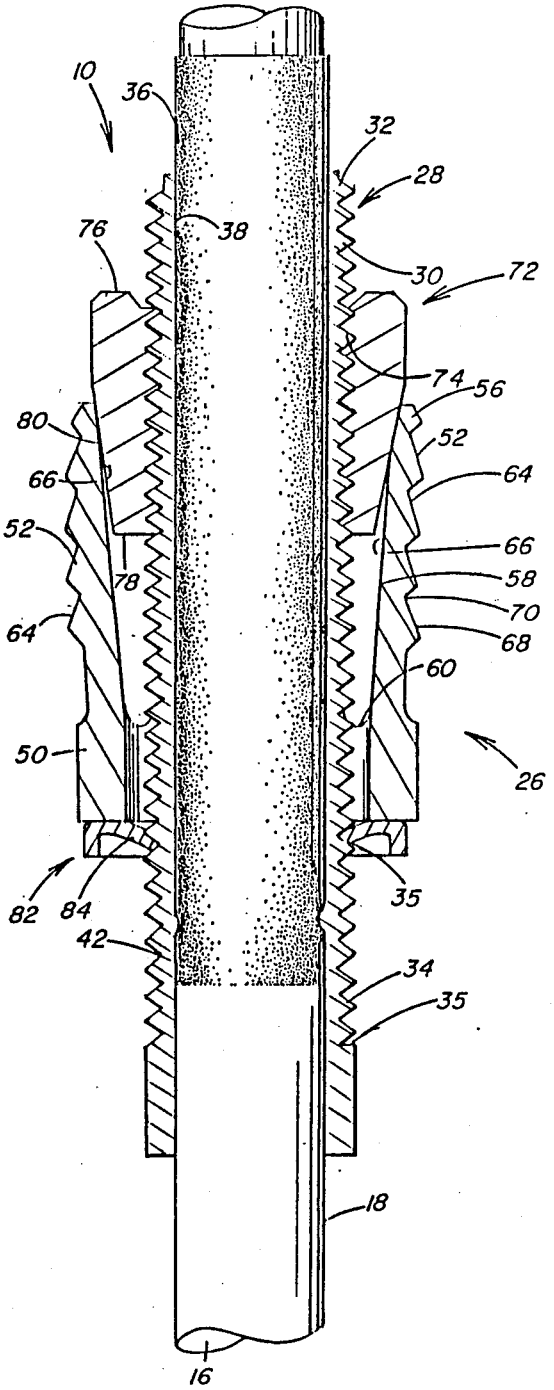
FIG. 2 is a sectional view of the roof bolt apparatus similar to that shown in FIG. 1 illustrating the externally threaded sleeve adhesively secured in a fixed axial position on the bolt with a camming plug engaging the threads of the sleeve and an expandable shell member surrounding the camming plug. The sleeve illustrated includes a lower portion that is not threaded.
Figure 3:
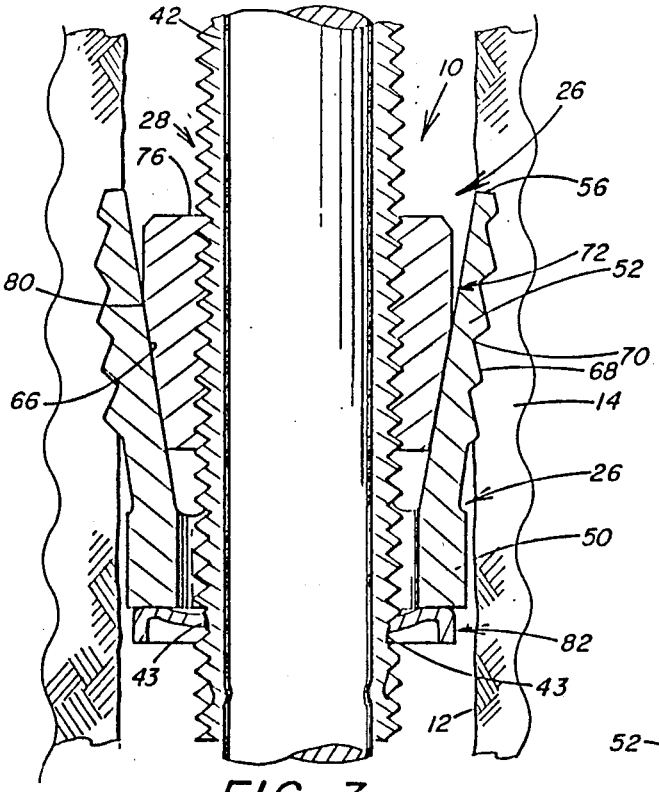
FIG. 3 is a view similar to FIG. 2, illustrating the shell member expanded into engagement with the rock formation surrounding the bore hole.
Figure 4:
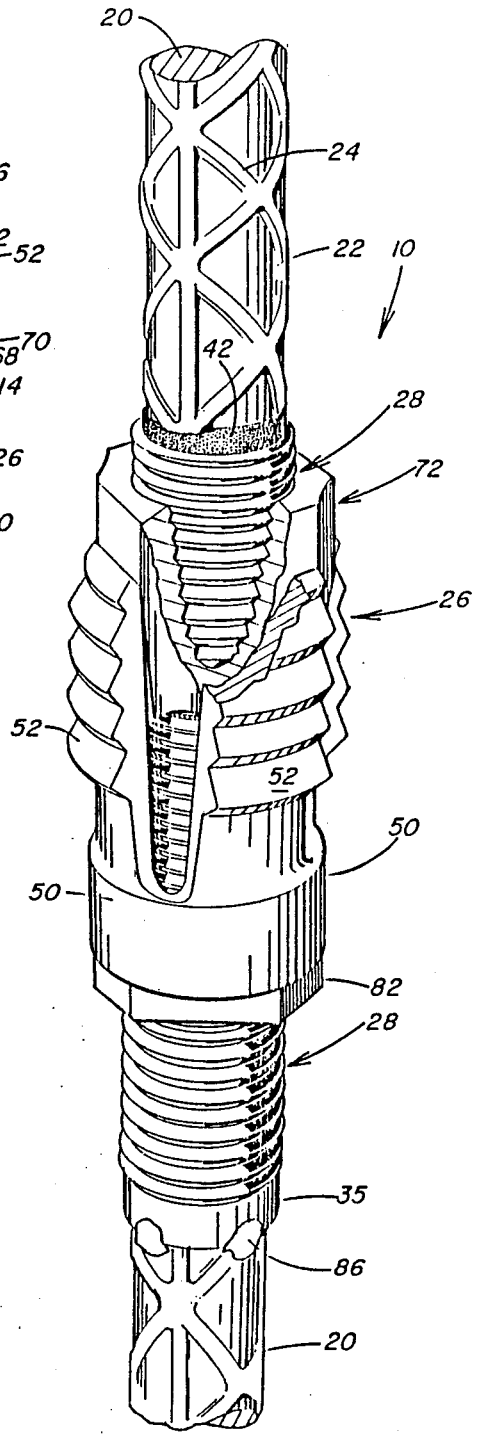
FIG. 4 is a view similar to FIG. 1, illustrating a reinforcing rod with an externally threaded sleeve welded thereto and an expansion shell assembly engaging the sleeve.
Figure 5:
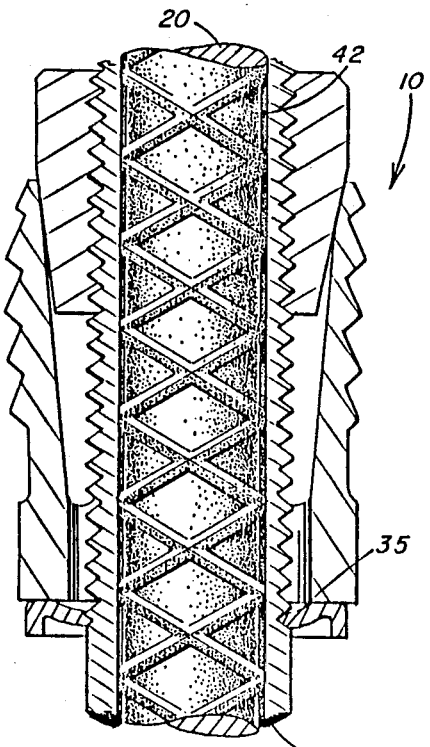
FIG. 5 is a sectional view of the roof bolt apparatus shown in FIG. 4, illustrating the sleeve secured at one end by spot welding to the surface of the rod and also adhesively bonded to the surface of the rod.

The roof bolt apparatus 10 includes, in one embodiment, as shown in FIGS. 1–3, an elongated bolt 16 having a smooth outer cylindrical surface 18. The bolt 16 has a preselected length, for example 42 inches to 6 feet or longer. In another embodiment of the roof bolt apparatus 10, as shown in FIGS. 4 and 5, a reinforcing rod 20 is utilized and includes an outer surface 22 on which is disposed a compound helical pattern of ribs 24. The ribs 24 protrude outwardly from the rod surface 22 and extend the length of the rod 20. Throughout the specification and claims, the terms bolt and rod will be used interchangeably to refer to that portion of the bolt apparatus to which the expansion shell assembly is secured.

An expansion shell assembly generally designated by the numeral 26 is positioned at a preselected location along the length of the bolt 16 or rod 20 and includes a sleeve 28, which is bonded to the bolt surface 18 or the rod surface 22. The sleeve 28 has an elongated body portion 30 with an upper end portion 32 and a lower end portion 34. An axial bore 36 extends through the sleeve body portion 30, thus forming a cylindrical inner surface 38 having a diameter corresponding substantially to the diameter of the bolt 16 or rod 20 permitting slidable movement of the sleeve 28 to a preselected location along the length of the bolt 16 or rod 20 before the sleeve 28 is secured thereto. The sleeve 28 has an outer threaded surface 40 that extends substantially the length of the sleeve body portion 30 from the upper end portion 32 to a position adjacent the lower end portion 34. As seen in FIG. 2, a portion of the sleeve outer surface is not threaded at the lower end portion 34 and serves as a stop 35 for a nut as later described. It should be understood other types of stops may be used, as for example, an interruption in the threads such as the peened portion 43 or an abutment means formed on the sleeve, as shown in FIG. 2.

As illustrated in FIGS. 1–3, the sleeve 28 is fixedly secured in a preselected position along the length of the bolt 16. In accordance with one method of the present invention the sleeve inner surface 38 is bonded to the outer cylindrical surface 18 of the bolt 16 by an adhesive material, such as an epoxy resin. The sleeve 28 can be fabricated from metal or other suitable material.

A wide variety of commercially available adhesives for joining metal to metal or metal to plastic, such as the adhesives used in the automotive and aircraft industries, as well as the adhesives utilized in the railway industry for bonding the fish plates to rails, are suitable for use in the present invention. A well known bonding material used in the railway industry, which is adaptable for use with the present invention is an ethoxyline resin known as "ARALDITE" sold by Ciba, Ltd. The adhesive material 42 is characterized by high shear strength, good adhesion to metals, good tensile and static and dynamic fatigue strengths. Accordingly, the components of the adhesive material are mixed and the mixture 42 is applied as a coating to a portion of the bolt outer surface 18. As illustrated in FIGS. 1 and 2, the length of the bolt 16, which is coated, corresponds to a length slightly greater than the length of the sleeve 28 to assure that the sleeve 28 is adhesively bonded along its entire length to the bolt outer surface 18. In addition the sleeve 28 may be peened or pressed into engagement with the bolt 16 at locations 43 around the sleeve lower end portion 34.

The sleeve 28 is adhesively bonded, as shown in FIGS. 1–3, at the desired location on the bolt 16 for positioning the remainder of the expansion shell assembly 26 at the desired location on the bolt 16 for engagement with the wall of the bore hole 12 at a desired location in the bore hole 12. FIGS. 6–9 illustrate selected positioning of the expansion shell assembly 26 on the rod 20 to assure that the expanded shell assembly 26 engages stable or hard rock strata 44 rather than unstable or soft, friable rock strata 46.

The expansion shell assembly 26, shown in detail in FIGS. 1 and 2, includes a shell member 48 having a ring end portion 50. A plurality of longitudinally extending fingers 52 extend axially from the ring end portion 50. Each finger 52 has a lower end portion 54 connected to the ring end portion 50 and an upper end portion 56. Longitudinal slots 58 divide the fingers 52 one from another. Each slot 58 has a closed end portion 60 adjacent the ring end portion 50 and an open end portion 62 adjacent the upper end portion 56 of each finger 52.

Each finger 52 includes an outer gripping surface 64 and an inner smooth surface 66. The outer gripping surface 64 includes a gripping portion 68 that extends from the finger upper end portion 56 to a position spaced from the finger lower end portion 54. The gripping portion 68 of each finger 52 includes a series of spaced, parallel, tapered, horizontal grooves 70. The grooves 70 form a series of downwardly extending serrations that are operable, upon expansion of the shell member 48 to engage the wall of the bore hole 12 as the fingers 52 bend outwardly.

The gripping portion 68 of each finger 52 is urged into contact with the wall of the bore hole 12 as seen in FIG. 3 by a camming plug or wedge generally designated by the numeral 72. The camming plug 72 has a unitary body portion with threaded axial bore 74 extending therethrough for receiving the sleeve outer threaded surface 40. The camming plug 72 has a tapered configuration with an enlarged upper end portion 76 and a reduced lower end portion 78. A portion of the inner surface 66 of each finger 52 abuts a tapered planar surface 80 of the camming plug 72.

The shell member 48 is maintained in surrounding relation with the camming plug 72 on the threaded sleeve 28 in a preselected location along the length of the bolt 16 by a nut generally designated by the numberal 82 in FIGS. 1–3. The nut 82 is commercially available under the trademark "PALNUT" and includes thread engaging portions 84, shown in FIGS. 2 and 3, which permit the nut 82 to be threaded onto the threaded surface 40 of the sleeve 28. The nut 82 is threaded to a preselected location on the sleeve 28. The shell member 48 and the camming plug 72 are advanced to a position on the threaded sleeve 28 to a location where the shell ring end portion 50 abuts the nut 82. In this manner, the shell member 48 is retained in a preselected position on the threaded sleeve 28. The nut 82 with the non threaded portion of the sleeve 35 serves as a stop device for the shell member 48 to permit expansion of the fingers 52 of the shell member 48. Other types of stop devices such as an interruption in the thread 40 on the sleeve 28 may be provided. Thus the camming plug 72, expansion shell 48 and nut 82 move downwardly on the sleeve 28 upon rotation of the bolt until the nut 82 abuts the stop 35 on the sleeve. The camming plug 72, upon further rotation of the bolt 16 moves relative to the expansion shell 48 and expands the shell fingers 52.

Now referring to FIGS. 4 and 5, there is illustrated the embodiment of the roof bolt apparatus 10 in which the threaded sleeve 28 is secured at a preselected axial position on the reinforcing rod 20. The expansion shell assembly and the sleeve shown in FIG. 4 are identical to the assembly 26 and sleeve 28 described above and illustrated in FIGS. 1–3. Therefore, like parts will be designated by like numerals in FIG. 4. Not only can the sleeve 28 be bonded by an adhesive material 42 to the surface 22 of the rod 20, the sleeve 28 can also be welded to the rod surface 22. For example, as shown in FIGS. 4 and 5, the sleeve lower end portion 34 is secured by spot welds 86 to the rod surface 22. Also, the sleeve 28 can be secured to the rod surface 22 by a continuous weld bead (not shown) around the sleeve lower end portion 34. The sleeve may also be secured by a pressing or distortion of the lower portion of the sleeve into the rod surface 22.

In the case of adhesively bonding the sleeve 28 to the rod 20, as illustrated in FIGS. 4 and 5, the adhesive material may be applied to the rod surface 22 and also to the ribs 24 or to the ribs 24 alone for adhesive contact of the sleeve 28 with the rod 20. Thus with this arrangement, the sleeve 28 can be secured in any desired location along the length of both the bolt 16 and the rod 20, thereby obviating the need to externally thread, for example, the respective end portions and the intermediate portion of either the bolt 16 or rod 20. With both means of securing the sleeve 28 to the bolt 16 or rod 20 by the adhesive material 42, spot welds 86 or other means, the sleeve 28 is nonrotatably secured so as to resist relative rotation between the sleeve 28 and the bolt 16 or rod 20 upon setting of the expansion shell 26 and resist axial movement upon tensioning the bolt 16 or rod 20 in the bore hole 12.

In accordance with the present invention, the means for selectively positioning the expansion shell assembly 26 at a desired axial location on the bolt 16 or rod 20 by the sleeve 28 can be utilized above or in combination with a chemical anchor as shown in FIGS. 6–9. As shown in FIG. 3, the expansion shell assembly 26 is operable upon downward movement of the camming plug 72 on the sleeve 28 secured to the bolt 16 to expand the fingers 52 outwardly into engagement with the wall of the bore hole 12. As shown in FIG. 3, the gripping portion 68 of the outer gripping surfaces of the fingers 52 are embedded in the bore hole wall to anchor the bolt 16 under tension in the bore hole 12.

It is the ability to locate the expansion assembly sleeve member 28 in a selective axial position on the rod 20 which permits the expansion shell assembly 26 to engage the rock formation at a desired location in the bore hole, as shown in FIGS. 6–9. This overcomes the problems inherent with locating the expansion shell assembly 26 at a point on the bolt 16 where the assembly is located in unstable or soft, friable rock strata.

Figures 6, 7, 8, 9:
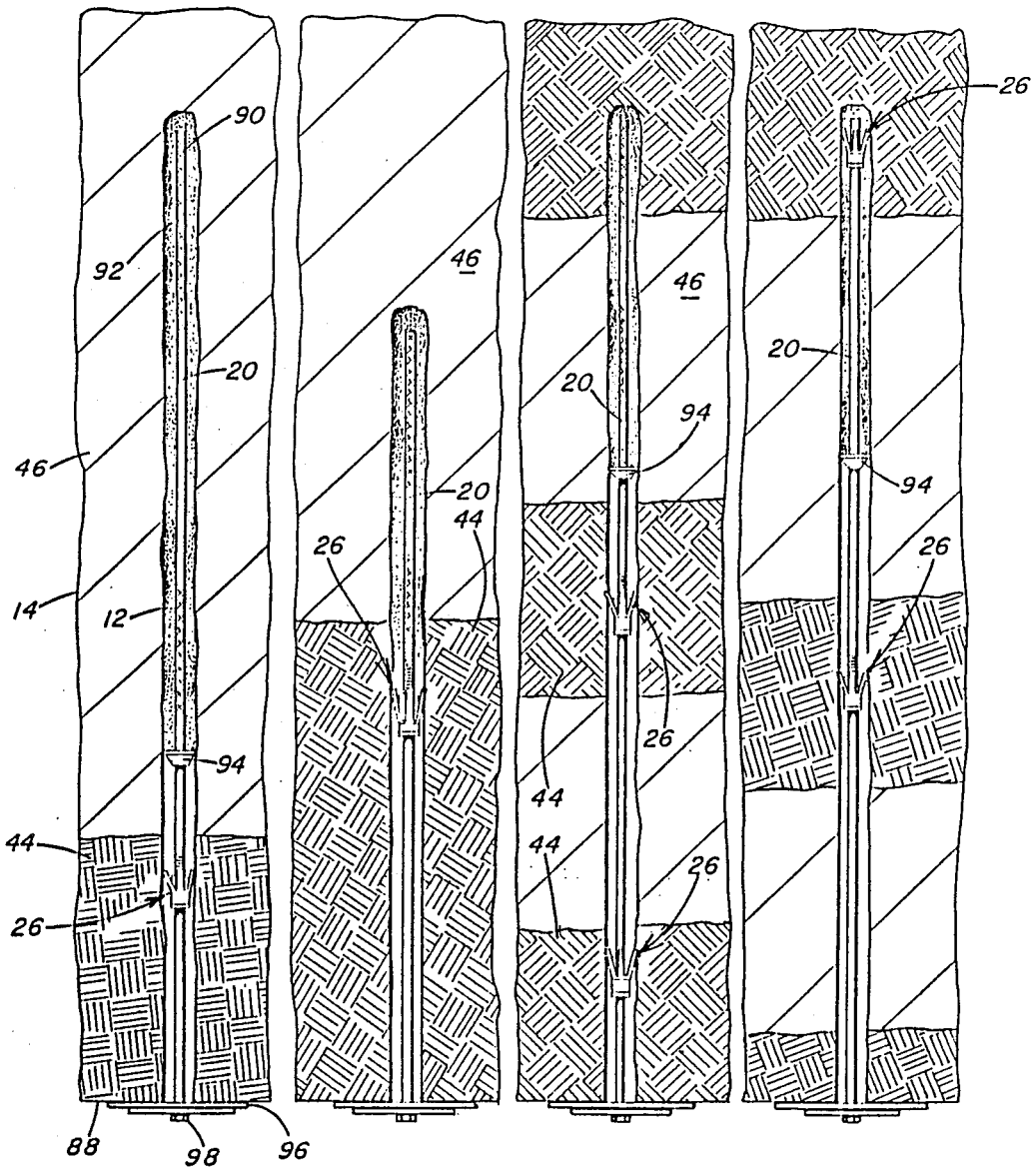
FIGS. 6–9 are schematic illustrations of the manner in which the expansion shell assemblies can be located at preselected locations along the length of a rod utilizing the threaded sleeve to mechanically anchor the rod to stable rock strata, and also to, chemically anchor the bolt in the bore hole.

As illustrated in FIG. 6, the rock formation 14 includes a seam of stable rock strata 44 adjacent a mine roof 88, and above the strata 44 lies a relatively thick seam of unstable rock strata 46. Therefore, to prevent the expansion of the shell assembly 26 in the unstable rock strata 46, which would be the case if the assembly 26 were conventionally mounted on an upper threaded end of the rod 20, the sleeve 28 of assembly 26 is positioned on and secured to the rod 20 for expanding the shell fingers 52 into engagement with the seam of the stable rock strata 44.

In addition to mechanically anchoring the rod 20 in the bore hole 12, the rod 20 can also be chemically anchored in the bore hole 12. Initially, the roof bolt apparatus 10, with the sleeve 28 bonded to the rod 20 in the desired location for positioning the expansion shell assembly 26 in the bore hole 12, is advanced upwardly behind one or more cartridges of a resin cartridge system. The cartridges contain the separated components of a resin or grout system. When the cartridges reach the upper closed end of the bore hole 12, further upward thrust and rotation of the rod 20 fracture the cartridges. The rod 20 is continuously rotated in a preselected direction to enhance the mixing of the resin components, thus forming the resin mixture 90 shown in FIGS. 6–8.

The resin mixture 90 flows downwardly into surrounding relation with the upper end of the rod 20 in the annulus 92 formed between the rod 20 and the wall of the bore hole 12. A washer 94 is positioned on the rod 20 spaced a preselected distance below the rod upper end portion. The washer 94 prevents the resin mixture 90 from flowing downwardly beyond a certain point in the bore hole 12.

Thus, as illustrated in FIG. 6–8, the upper end portion of the rod 20 is chemically anchored in the relatively soft, unstable rock strata and the rod 20 is mechanically secured in the hard or stable rock strata by the expansion shell assembly.

In FIG. 8, where three relatively thin strata of hard stable rock 44 with unstable relatively soft strata therebetween, a pair of expansion shell assemblies 26 are secured to the rod 20 at preselected locations on the rod 20, so that they will expand and mechanically anchor the rod 20 in the stable strata 44. As illustrated, the upper portion of the rod 20 is chemically anchored in the upper stable strata 44, and also in the soft strata 46. It should be understood, as illustrated in FIG. 9, that the end of the rod 20 could be both mechanically and chemically anchored in the top strata 44. Although a rod or rebar 20 is illustrated in FIGS. 6–9, it should be understood that a bolt 16 could also be used with the above-described arrangements.

FIG. 9 illustrates the versatility of the expansion shell assemblies, 26 where they are positioned in the upper two spaced layers 44 of stable rock, and the bolt is both mechanically and chemically anchored to the upper stable layer of rock 44. Although not illustrated, it should be understood, that the expansion shell assembly 26 could also be positioned on the rod 20 in the bottom relatively thin layer of hard stable rock to prevent spalling of this layer 44.

One manner in which the bolt assembly can be prepared utilizing the sleeve member 28 and the expansion shell assembly includes first positioning the nut 82 on the sleeve member and thereafter positioning the expansion shell 26 in abutting relation with the nut 82 and the camming plug 72 threadedly secured on the sleeve 28 in abutting relation with the inner surfaces of the expansion shell fingers 52. The assembly consisiting of the sleeve 28, nut 82, expansion shell 26 and camming plug 72 as a unit are positioned on a roof bolt 18, the adhesive is applied to the portion of the roof bolt where it is desired to position the sleeve 28. The sleeve 28 is then slideably positioned on the bolt 18 in overlying relation with the adhesive and if desired the sleeve 28 may be peened to the bolt as illustrated at 43 in Firgure 1. With this arrangement, the expansion shell assembly and the threaded sleeve are connected as a unit and the unit is then positioned on the roof bolt at a preselected location so that the entire assembly as a unit may be positioned on the roof bolt.

The roof bolts according to the present invention are installed in the foillowing manner. One or mre cartridges of a two component resin are first inserted into the bolt hole. Various types of resins including quick setting resins such as the resin described in U.S. Pat. No. 4,216,180 may be used. The bolt, with one or more expansion shell assemblies 26 secured at preselected locations on the rod 20 and a washer 94 positioned at a preselected location on the rod 20, is inserted into the bolt hole with a bearing plate 96 abutting the bolt head 98. The bolt is moved upwardly into the bolt hole to break the resin cartridges, and move the bearing plate 96 adjacent to the roof surface 88. The bolt is rotated to mix the resin and move the camming plug 72 expansion shell 48 and nut 82 axially on the threaded sleeve 28. When the nut 82 moves into abutting relation with the stop 35 the camming plug 72 moves relative to the expansion shell 48 and expands the fingers 52 to mechanically engage the bolt 20 to the respective strata. Further rotation of the bolt moves the bolt upwardly in the camming plug 72 which is now anchored by the expansion shell and rotation of the bolt or rod 20 applies a tension to the rod 20 between the expansion shell assemblies and the roof surface 88. Although FIGS. 6–9 illustrate a combination of a mechanical anchor by the expansion shell assemblies 26 and the chemical anchor by the resin 92, it should be understood that the invention may also be practiced without the chemical resin anchor.

Figure 10:
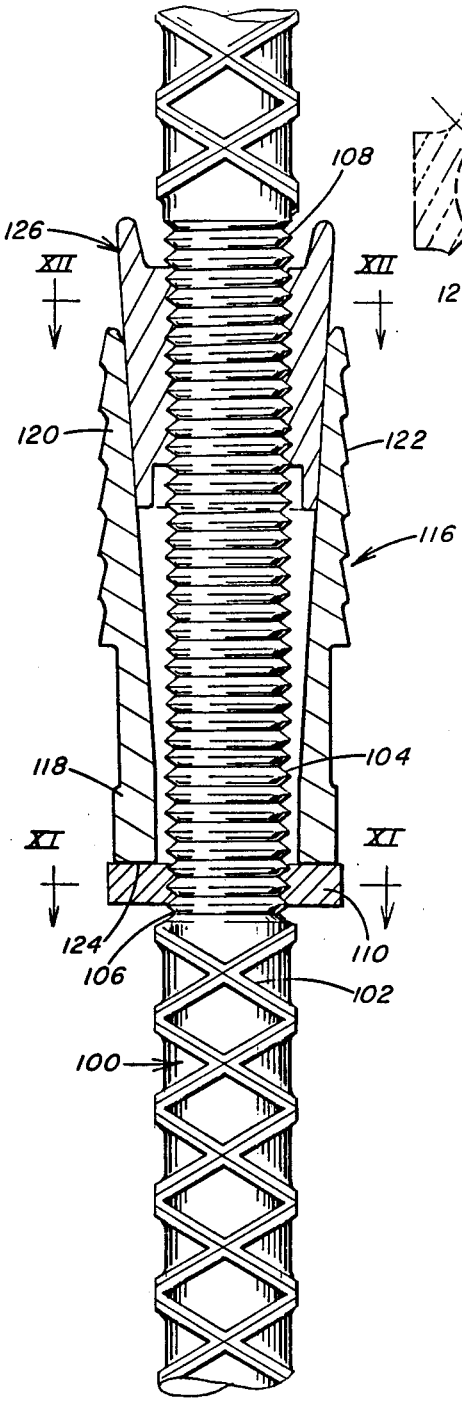
FIG. 10 is a view similar to FIG. 1 in which the rod or bolt member has a threaded portion and the expansion shell assembly is positioned on the threaded portion of the bolt.
Figure 12:
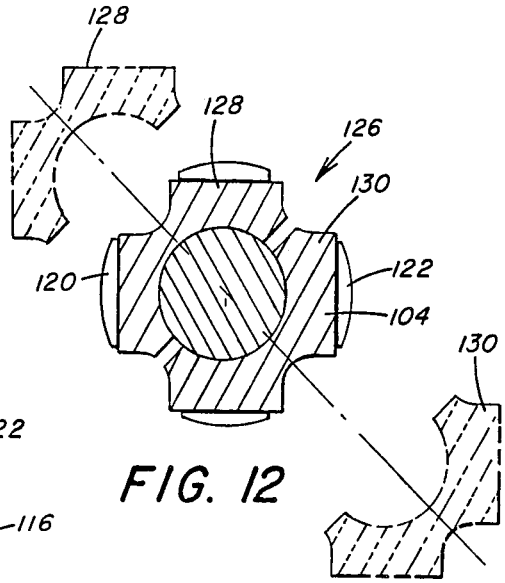
FIG. 12 is a view in section taken along the line 12—12 illustrating the portions of the camming plug both in abutting relation with the threaded portion of the bolt and in a position with the halves of the camming plug separated therefrom.
Figure 11:
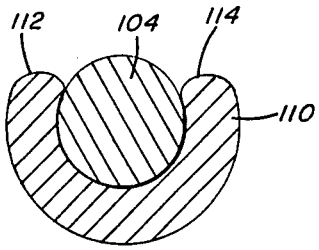
FIG. 11 is a view in section taken along the line 11—11 illustrating the stop member engaging the threaded portion of the bolt.

In another embodiment of the invention illustrated in FIGS. 10–12, the roof bolt 100 which in FIG. 10 is a rebar having raised portions 102. The roof bolt 100 has a threaded portion 104 which is formed on the bolt 100 by means of clamp type threading device so that the thread can be formed intermediate the end portions of the bolt as illustrated in FIG. 10. The threaded portion of the bolt 104 has a lower end 106 and an upper end 108. It should be understood as previously discussed that the threaded portion 104 may be formed on the roof bolt 100 at any preselected location along the bolt. A stop member 110 is secured to the bolt threaded portion 104 adjacent the lower end portion 106. The stop member 110 has a generally C-shaped configuration and is snapped onto the threaded portion 104 and has end portions 112 and 114 which extend beyond the diameter of the threaded portion of the bolt 104 to thus provide clamping action of the stop 110 on the bolt 104. A conventional expansion shell 116 has a lower ring portion 118 and plurality expandable fingers 120 and 112. It should be understood that another pair of expandable fingers extend from the ring member and are not shown in FIG. 10. The ring member 118 has a lower edge portion 124 in abutting relation with the upper surface of the C-shaped stop 110. A camming plug generally designated by the numeral 126 has a first half 128 and a second half 130. Preferably the camming plug halves 128 and 130 are formed by cutting the threaded camming plug longitudinally as illustrated in FIG. 12 to form a pair of longitudinal halves 128 and 130. The camming plug halves 128 and 130 are illustrated in dotted lines in a mode separated from the bolt threaded portion 104. The camming plug 126 is positioned with the halves 128 and 130 in abutting relation with the threads of the bolt threaded portion 104 and the fingers 120 and 122 are positioned to urge the camming plug halves 128 and 130 toward each other and also into threaded engagement with the threads 104 on the bolt 100.

It will be appreciated that the camming plug is maintained in threaded engagement with the threads 104 of bolt 100 by the force exerted thereon by the fingers 120 and 122 and the other fingers on the expansion shell not illustrated.

The embodiment in FIGS. 10–12 operates in a manner similar to the embodiment previously described in that the expansion shell assembly may be positioned anywhere along the length of the bolt determined in this embodiment only by the location of the threaded portion on the bolt. Upon rotation of the bolt 100, the camming plug 126 moves downwardly relative to the expansion shell assembly 116 and expands the fingers 120 and 122 into anchoring relation with the bore hole as previously described with the other embodiments.

With the arrangement illustrated in FIGS. 10–12, the expansion shell assembly may be positioned anywhere along the length of the bolt 100 and the chemical anchor or bond may be positioned above the elevation of the expansion shell assembly or the chemical anchor may include an area in which the expansion shell assembly is positioned and may extend downwardly below the expansion shell assembly. With this arrangement, it is now possible to obtain a chemical and mechanical anchored on roof bolt in which the mechanical anchor is located at a preselected location along the length of the bolt and the chemical anchor is preferably positioned above the mechanical anchor.

According to the provisions of the patent statutes, I have explained the principal, preferred construction and mode of operation of my invention and have illustrated and described what I now consider to represent its best embodiments. However, it should be understood that within the scope of the appended claims, the invention may be practiced otherwise than as specifically illustrated and described.

I claim:

1. An expansion shell assembly comprising, a sleeve having a body portion with an upper end portion and a lower end portion and an axial bore extending through said body portion, said body portion having an inner surface and an outer threaded surface, a camming plug having a threaded axial bore and an outer surface, said camming plug threadedly engaged to said sleeve at a preselected location on said sleeve outer threaded surface, an expandable shell having a plurality of longitudinally extending fingers spaced from one another by longitudinal slots, said fingers each having an inner surface and an outer surface, each finger inner surface abutting said camming plug outer surface, said camming plug being movable on said sleeve outer threaded surface relative to said expandable shell to exert an outward force upon said inner surfaces of said fingers to expand said fingers outwardly from said sleeve, and said expansion shell assembly arranged to be secured to a roof bolt at a preselected location along the length of said roof bolt with the inner surface of the sleeve secured to the outer surface of said bolt.

2. An expansion shell assembly as set forth in claim 1 in which said expandable shell includes, a ring portion with said fingers extending upwardly therefrom, retaining means secured to said sleeve, said expandable shell ring portion arranged to abut said retaining means to maintain said expandable shell on said sleeve.

3. An expansion shell assembly as set forth in claim 1 in which said expandable shell includes, a ring portion with said fingers extending upwardly therefrom, a nut member threadedly secured to said sleeve, said expandable shell ring portion arranged to abut said nut to maintain said expandable shell on said sleeve.

4. An expansion shell assembly as set forth in claim 2 which includes, stop means on said sleeve, said retaining means upon rotation of said camming plug on said sleeve arranged to abut said stop means and permit relative movement of said camming plug and said expandable shell on said sleeve to expand said expandable shell finger.

5. An expansion shell assembly as set forth in claim 3 which includes stop means on said sleeve, said nut arranged to move axially on said sleeve into abutting relation with said stop means and permit relative movement of said camming plug and said expandable shell on said sleeve to expand said expandable shell fingers.

6. Apparatus for anchoring a bolt in a bore hole of a rock formation comprising, an elongated bolt having unthreaded portions extending between the ends thereof, a sleeve having a body portion with an inner surface and an outer threaded surface, said sleeve body portion having an upper end portion and a lower end portion with an axial bore through said body portion, said sleeve axially positioned on said bolt unthreaded portion at a preselected location, said sleeve being secured to said bolt outersurface, a camming plug having a threaded axial bore and an outer surface, said camming plug threadedly engaged to said sleeve at a preselected location on said sleeve outer threaded surface, an expandable shell having a plurality of longitudinally extending fingers spaced from each other by longitudinal slots, said fingers each having an inner surface and an outer surface, said expandable shell positioned on said sleeve with said finger inner surface abutting said camming plug outer surface, and said camming plug being movable on said sleeve outer threaded surface relative to said expandable shell upon rotation of said bolt to expand said fingers outwardly from said sleeve.

7. Apparatus for anchoring a bolt in a bore hole of a rock formation as set forth in claim 6 in which, said sleeve being at least partially secured to said bolt outer surface by a resin material adhesively securing said sleeve inner surface to said bolt outer surface.

8. Apparatus for anchoring a bolt in a bore hole of a rock formation as set forth in claim 6 in which, said sleeve being at least partially secured to said bolt by a metallic weld securing the lower end portion of said sleeve to said bolt outer surface.

9. Apparatus for anchoring a bolt in a bore hole of a rock formation as set forth in claim 6 which includes, stop means on said sleeve adjacent said sleeve lower portion, said expandable shell having a ring portion positioned axially on said sleeve, said expandable shell arranged, upon rotation of said bolt to abut said stop means and permit said camming plug to expand said fingers.

10. Apparatus for anchoring a bolt in a bore hole of a rock formation as set forth in claim 9 which includes.

a nut threadedly positioned on said sleeve below said expandable shell ring portion and in spaced relation to said sleeve lower end portion, said nut arranged to move downwardly into abutting relation with said stop means.

11. A method of anchoring a bolt in a bore hole of a rock formation comprising, positioning an expandable shell around a sleeve, said expandable shell having a ring portion with fingers extending therefrom, said sleeve having an outer threaded surface, threadedly engaging a camming plug with said expandable shell mounted thereon to said sleeve to form an expansion shell assembly, axially securing said expansion shell assembly to the outer surface of a roof bolt at a preselected location along the length of said roof bolt, inserting said bolt with said expansion shell assembly into a bore hole of a rock formation, and rotating said bolt to move said camming plug axially on said threaded sleeve relative to said expandable shell to expand said fingers and anchor said roof bolt in said bore hole by said expansion shell assembly at a preselected location along the length of the roof bolt.

12. A method of anchoring a bolt in a bore hole of a rock formation comprising, positioning an expandable shell around a sleeve, said expandable shell having a ring portion with fingers extending therefrom, said sleeve having an outer threaded surface, threadedly engaging a camming plug with said expandable shell mounted thereon to said sleeve to form an expansion shell assembly, axially securing a plurality of said expansion shell assemblies to the outer surface of the roof bolt at preselected locations along the length of said bolt, inserting said bolt with said expansion shell assemblies secured thereto into a bore hole of a rock formation, and rotating said bolt to move said camming plugs of said expansion shell assemblies axially on said threaded sleeves relative to said expandable shells to expand said fingers and anchor said roof bolt in said bore hole at each preselected location of said expansion shell assemblies along the length of said bolt 13. A method of anchoring a bolt in a bore hole of a rock formation comprising, axially securing a sleeve to the outer surface of a roof bolt at a preselected location along the length of said roof bolt and spaced longitudinally from the end of said roof bolt, said sleeve having an outer threaded surface, positioning an expandable shell around said sleeve, said expandable shell having a ring portion and upwardly extending fingers, threadedly engaging a camming plug with said expandable shell mounted thereon to said sleeve, inserting at least one cartridge of a multi component resin into said bore hole, thereafter inserting said bolt with said camming plug threadedly engaged to said sleeve into said bore hole of a rock formation, moving said bolt upwardly to fracture said one or more cartridges of resin material, rotating said bolt to mix at least a portion of said resin material, and, thereafter upon further rotation of said bolt moving said camming plug axially relative to said expandable shell to expand said fingers and anchor said bolt in said bore hole by said expansion shell assembly and by said resin material.

14. A method of anchoring a bolt in a bore hole of a rock formation as set forth in claim 13 which includes, positioning a roof plate on said bolt, inserting said bolt with said camming plug threadedly engaged to said sleeve into a bore hole of a rock formation until the end of the bolt with the plate positioned thereon abuts the roof surface, and thereafter, rotating said bolt to move said camming plug axially on said sleeve relative to said expandable shell to expand said fingers and anchor said bolt in said bore hole by said expansion shell assembly and applying tension to said bolt by rotation of said bolt in said expansion shell assembly.

15. A method of anchoring a bolt in a bore hole of a rock formation comprising, positioning a stop means on a sleeve having an outer threaded surface, positioning an expandable shell around the said sleeve, said expandable shell having a ring portion and upwardly extending fingers, said ring portion abutting said stop means, threadedly engaging a camming plug to said sleeve, positioning said sleeve on said bolt with said stop means, expandable shell and said camming plug mounted thereon at a preselected location along said bolt, and securing said threaded sleeve to said bolt outer surface

* * * * *